US005933684A

United States Patent [19]

Mashtare et al.

[11] Patent Number: 5,933,684

[45] Date of Patent: Aug. 3, 1999

[54] INTERACTIVITY SENSOR FOR ELECTROPHOTOGRAPHIC PRINTING

[75] Inventors: Dale R. Mashtare, Macedon; Christopher Snelling, Penfield, both of N.Y.

[73] Assignee: Xerox Corporation, Stamford, Conn.

[21] Appl. No.: 09/004,635

[22] Filed: Jan. 8, 1998

[51] Int. Cl.[6] ..... G03G 15/08

[52] U.S. Cl. ..... 399/53; 399/55; 399/290; 399/291

[58] Field of Search ..... 399/53, 54, 55, 399/56, 177, 272, 252, 265, 266, 290, 291, 64, 65, 149, 150, 267, 270, 271; 250/353

[56] References Cited

U.S. PATENT DOCUMENTS 4,431,300 2/1984 Snelling ..... 399/65

5,404,208 4/1995 Edmunds ..... 399/266

*Primary Examiner*—Arthur T. Grimley
*Assistant Examiner*—Hoan Tran
*Attorney, Agent, or Firm*—Lloyd F. Bean, II

[57] ABSTRACT

An apparatus in which the developability and interactivity of electrostatically charged particles in a mixture of particulate material is measured. The sensor apparatus includes a transparent member positioned closely adjacent to a developer roller of an electrophotographic printing machine. Electrostatically charged particles are attracted from the particulate mixture being transported by the developer roller to the member. A beam of energy is transmitted through the member. The intensity of the internally reflected beam is detected and a signal generated indicative of the quantity of charged particles adhering to the member. A cleaning field bias is applied, to determine if a signal indicative of the charge particles being removed (interactivity) from the member is generated.

3 Claims, 6 Drawing Sheets

INTERACTIVITY SENSOR FOR ELECTROPHOTOGRAPHIC PRINTING

This invention relates generally to an electrophotographic printing machine, and more particularly concerns an apparatus and method for sensing electrostatically charged particles in a mixture of particulate material.

Generally, the process of electrophotographic printing includes charging a photoconductive member to a substantially uniform potential so as to sensitize the surface thereof. The charged portion of the photoconductive surface is exposed to a light image from either a scanning laser beam or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing (IOI), superimposes toner powder images of different color toners onto the photoreceptor prior to the transfer of the composite toner powder image onto the substrate. While the image on image process is beneficial, it has several problems. For example, when recharging the photoreceptor in preparation for creating another color toner powder image it is important to level the voltages between the previously toned and the untoned areas of the photoreceptor.

Moreover, the viability of printing system concepts such as image on image processing usually requires development systems that do not scavenge or interact with a previously toned image. Since several known development systems, such as conventional magnetic brush development and jumping single component development, interact with the image receiver, a previously toned image will be scavenged by subsequent development, and as these development systems are highly interactive with the image bearing member, there is a need for scavengeless or noninteractive development systems.

For a high quality xerographic imaging and particularly for IOI architectures the need for a noninteractive development (NID) process is imperative, to maintain the high level of quality closed loop process controls are required to monitor the system. As it responds to changes in materials life or environmental effects, for example. Developability and, perhaps more importantly for color systems, interactivity must be monitored to insure consistently high levels of image quality. The No-Gap ADC (Automatic Developability Control) sensor can be applied to provide information for both of these NID subsystem performance measures. In U.S. Pat. No. 4,431,300, incorporated herein by reference, describes the application of a total internal reflection (TIR) sensor to monitor the process performance of a development subsystem. The sensor consisting of an optical prism with LED and photodetector arrangement, provides a true measure of developability as toner is developed onto the conductive prism face. The output from the photodetector circuitry is a voltage signal corresponding to the light internally reflected within the prism structure. Toner particles deposited onto the prism face attenuate the reflected IR wavelength light due to scattering and absorption resulting in a signal output proportional to the DMA on the prism face.

In the case of noninteractive development (NID) subsystems toner typically develops across an airgap on to the latent electrostatic image on the photoreceptor. To enable image on image (IOI) system architectures it is critical that the NID subsystem develop this toner in nonscavenging manner so as to not contaminate previously developed images present on the photoconductive surface or developer sumps for subsequent layers. Presently, subsystems are set to accommodate this requirement with no real monitor of scavenging which may occur. NID subsystem parameter shifts including TC/tribo, particle size shifts, toner adhesive/cohesive properties, RH conditions could all result in variations in both developability and interactivity such that subsystems latitude windows narrow. In a development system it is highly desirable to have a system which enables greater simplicity and latitudes in developing high quality, full color images with an image on image process; and enables high speed development.

In accordance with one aspect of the present invention, there is provided, a sensing technique that has been applied to typical interactive development subsystems such as a two component mag brush. In these applications the sensor face is in physical contact with the developer bed. The "developed" toner that creates the signal indicative of developability may be removed by appropriately changing the bias applied to the conductive prism face to create a cleaning field (interactivity). The mag brush then acts in the manner of a mag brush cleaner. Subsequent reapplication of bias for development will cause the generation of a new developability measure.

In a development system it is highly desirable to have a system which enables greater simplicity and latitudes in developing high quality, full color image with an image on image process; and enables high speed development.

Other features of the present invention will become apparent as the following description proceeds and upon reference to the drawings, in which:

FIG. 8 illustrates the developer apparatus in which the present invention can be employed in;

While the present invention will hereinafter be described in connection with various embodiments and methods of use, it will be understood that it is not intended to limit the invention to these embodiments and methods of use. On the contrary, it is intended to cover all alternatives, modifications and equivalents as may be included within the spirit and scope of the invention as defined by the appended claims.

Figure 1:
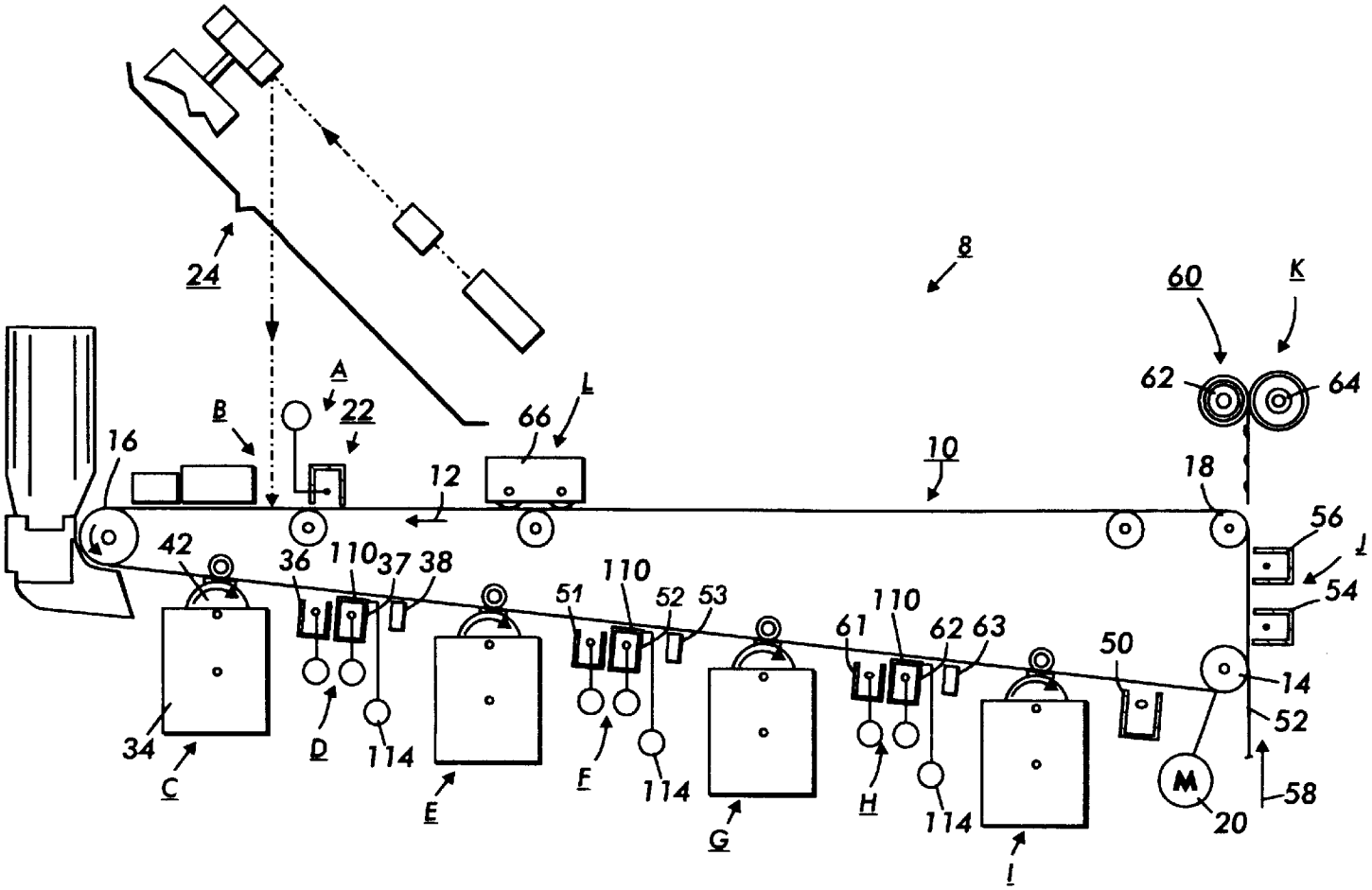
FIG. 1 is a schematic elevational view of an illustrative electrophotographic printing or imaging machine or apparatus incorporating a development apparatus having the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the features of the present invention therein. It will become apparent from the following discussion that the apparatus of the present invention is equally well suited for use in a wide variety of machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

Referring initially to FIG. 1, there is shown an illustrative electrophotographic machine having incorporated therein the development apparatus of the present invention. An electrophotographic printing machine 8 creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2:
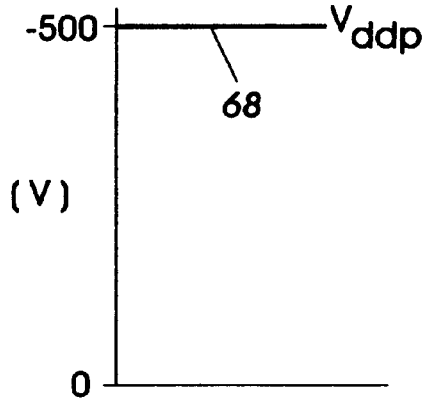
FIG. 2 shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2 illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2 shows the image area as being negatively charged, it could be positively charged if the charge levels and polarities of the toners, recharging devices, photoreceptor, and other relevant regions or devices are appropriately changed.

Figure 3:
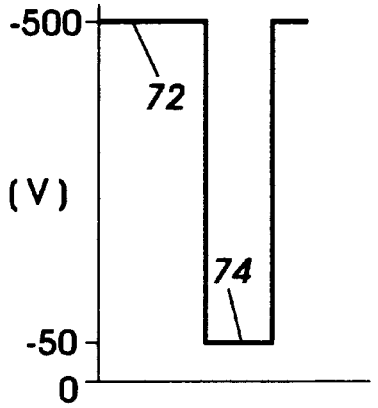
FIG. 3 shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 3 shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner onto the image area. That toner is attracted to the less negative sections of the image area and repelled by the more negative sections. The result is a first toner powder image on the image area.

Figure 8:
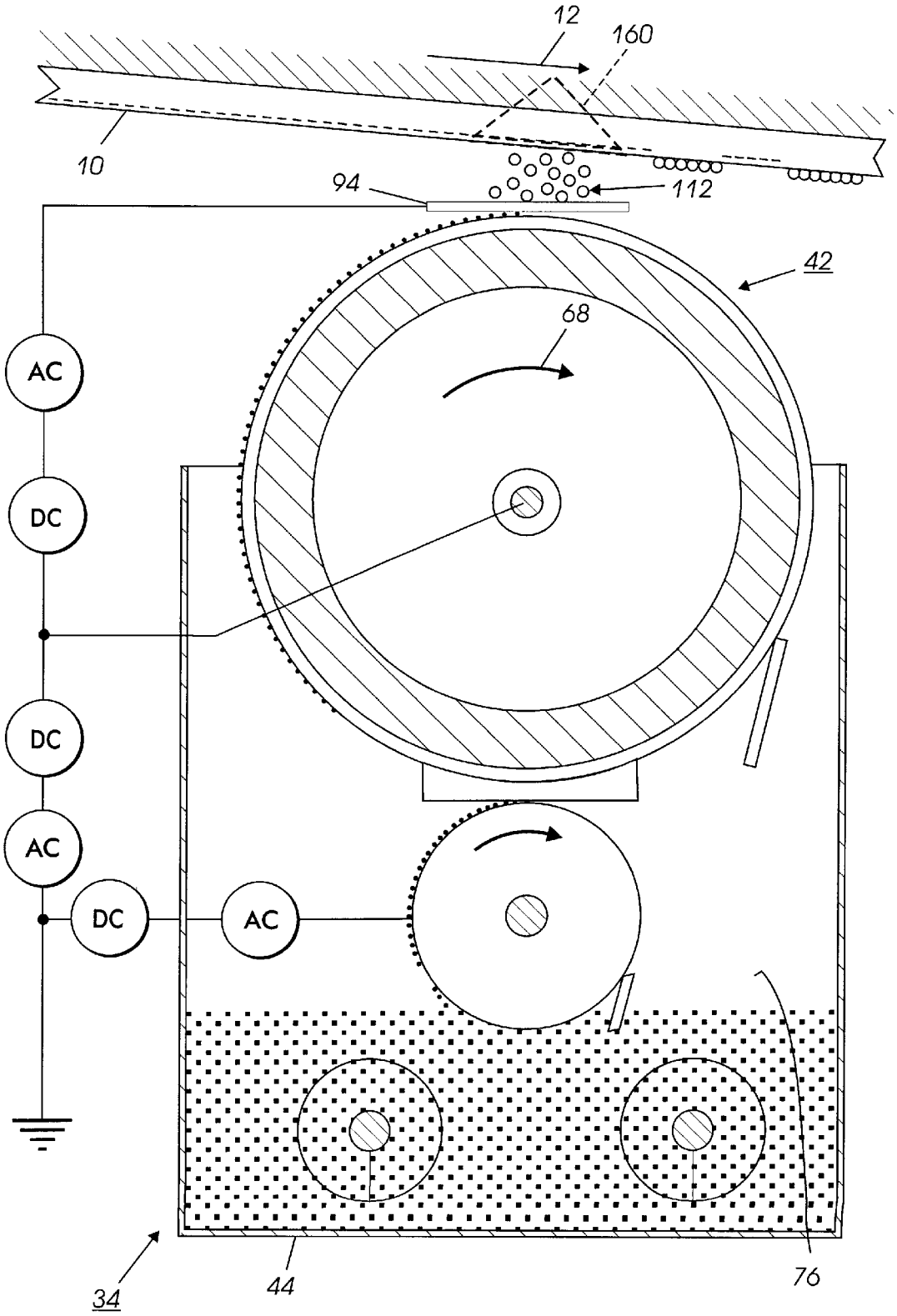

For the first development station C, development system 34 includes a donor roll 42. Donor roll 42 is mounted, at least partially, in the chamber of developer housing 44 as depicted in FIG. 8. The chamber in developer housing 44 stores a supply of developer (toner) material develops the image.

Figure 4:
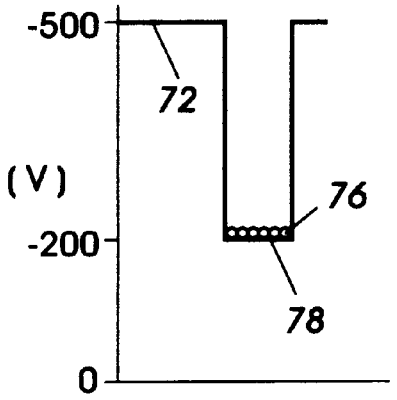
FIG. 4 shows a typical voltage profile of the image area after being developed.

FIG. 4 shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 5:
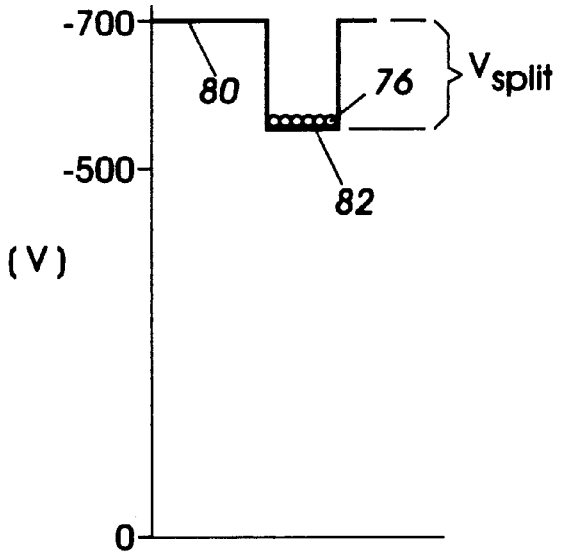
FIG. 5 shows a typical voltage profile of the image area after being recharged by a first recharging device.

FIG. 5 shows the voltages on the image area after it passes through the first recharging device 36. The first recharging device overcharges the image area to more negative levels than that which the image area is to have when it leaves the recharging station D. For example, as shown in FIG. 5 untoned parts of the image area, reach a voltage level 80 of about −700 volts. The first recharging device 36 is preferably a DC scorotron.

Figure 6:
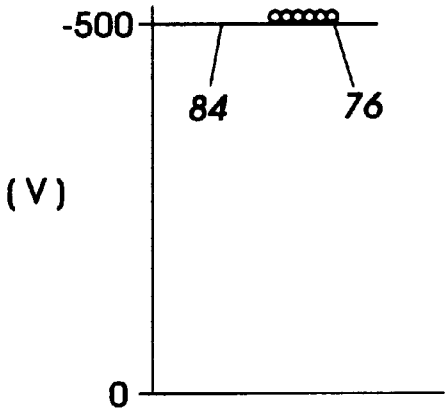
FIG. 6 shows a typical voltage profile of the image area after being recharged by a second recharging device.
Figure 7:
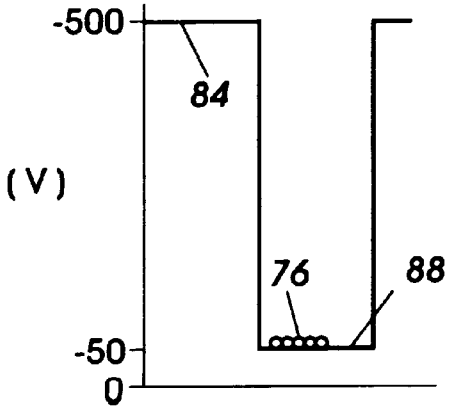
FIG. 7 shows a typical voltage profile of the image area after being exposed for a second time.

After being recharged by the first recharging device 36, the image area passes to the second recharging device 37. Referring now to FIG. 6, the second recharging device 37 reduces the voltage of the image area, both the untoned parts and the toned parts (represented by toner 76) to a level 84 which is the desired potential of −500 volts.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 6 illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner which is of a different color (yellow) than the toner 31 (black) in the first development station C, the second development station is beneficially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station 1.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

Referring now to FIG. 8 in greater detail development system 34 includes a donor roll 42. As illustrated in FIG. 8, electrodes 94 is electrically biased with an AC and DC voltage relative to donor roll 42 for the purpose of detaching toner therefrom so as to form a toner powder cloud 112 in the development gap between the donor roll and photoconductive surface. Both electrodes 94 and donor roll 42 are biased at DC potentials for discharge area development (DAD). The discharged photoreceptor image attracts toner particles from the toner powder cloud 112 to form a toner powder image thereon.

Figure 9:
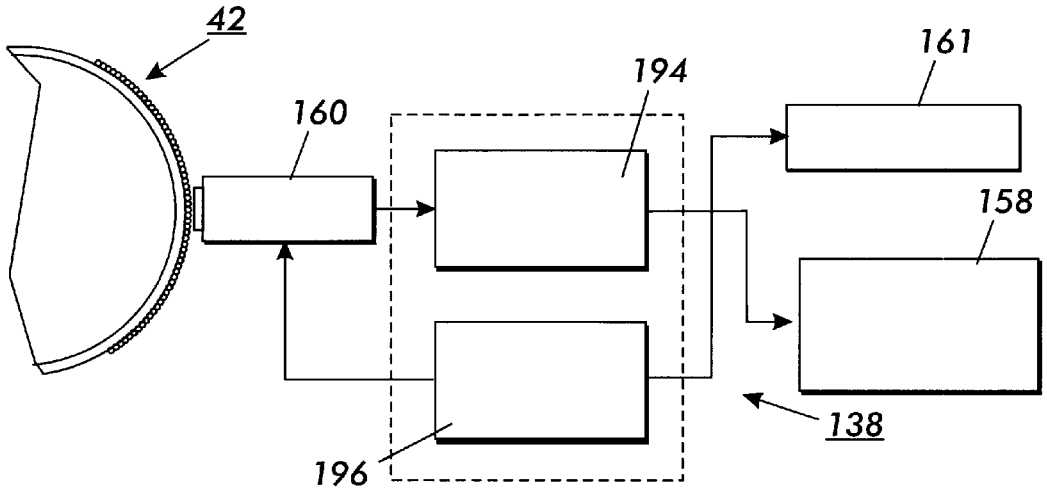
FIG. 9 is a schematic elevational view of the sensing circuitry associated with the present invention.
Figure 10:
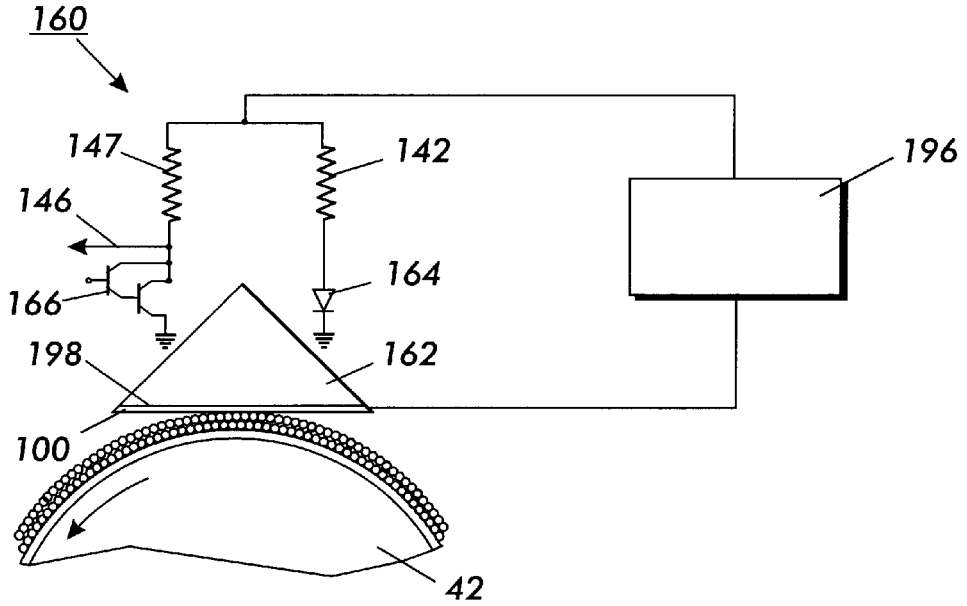
FIG. 10 is a schematic elevational view showing an embodiment of the prism, light source and light sensor of the present invention.

Referring now to FIGS. 9 and 10 a sensor, indicated generally by the reference numeral 160 is positioned closely adjacent to developer roller 42. Sensor 160 comprises a substantially transparent prism 162 adapted to attract toner particles from the developer material adhering to developer roller 42. A light source 164 transmits light rays through prism 162 onto the toner particles adhering thereto. Light rays internally reflected through prism 162 are detected by light detector 166. Light detector 166 develops an electrical output signal which is transmitted to controller 138. Controller 138 develops a signal which actuates motor 158 to dispense toner particles into developer housing 44. Thus, when the quantity of toner particles adhering to prism 162 is beneath a predetermined level, controller 138 actuates motor 158 to dispense additional toner particles into the developer material. The dispensing of additional toner particles into the developer material adjusts the developability of the system to the desired level.

Referring now to FIG. 10, prism 162 is preferably a right triangular prism with the hypotenuse, i.e. surface 198, having a substantially transparent electrically conductive layer 100 adhering thereto. Preferably, electrically conductive layer 100 is a transparent tin oxide coating which is made by Pittsburgh Plate Glass under the trademark NESA or is made by the Corning Glass Company under the trademark Electroconductive. The angles of transparent prism 162 opposed from the legs are equal and 45 degree. Voltage source 196 is coupled to electrically conductive layer 100 so as to electrically bias the surface of prism 162, thereby attracting toner particles being transported on developer roller 42 thereto. Light source 164 is preferably a light emitting diode with light detector 166 being a phototransistor. Light emitting diode 164 is coupled to voltage source 196 by resistor 142. Similarly, phototransistor 166 is coupled to voltage source 196 by resistor 147. Preferably, resistor 142 is about 560 ohms with resistor 147 being about 2200 ohms. The voltage applied across resistor 147 and phototransistor 166, which is connected in parallel with light emitting diode 164 and resistor 142 is preferably about 6 volts D.C. Line 146 transmits the electrical output signal from phototransistor 166 to level detector 194.

In operation, phototransistor 166 senses the changes in internal reflectance from the surface on which the toner particles are developed. By Snell's law, internal reflectance occurs up to a critical angle. The critical angle is measured with respect to the normal surface. The value of the critical angle, $\theta_c$, is determined by the relationship $\sin \theta_c = N_1 / N_2$ with $N_1$ and $N_2$ being the indices of refraction of the material in contact with the surface and the optical element respectively. Inasmuch as the presence of toner particles on the surface replaces air, the index of refraction is greater than 1. Thus, the critical angle is greater than the critical angle in the absence of toner particles on the surface. As toner particle deposition occurs on the surface, the critical angle increases and the magnitude of the internally reflected light detected is reduced. By way of example, the critical angle, without particles, is about 41.5 degree when the index of refraction of the prism is about 1.52.

It is believed that this system operates by detecting the intensity of radiation internally reflected from the hypotenuse of the right angle prism. The presence of toner particles on the prism face causes a decrease in the detected light intensity which corresponds to a decrease in the effective internal reflectivity of the surface. The total "internal" reflected radiation field extends beyond the prism face a distance on the order of a wavelength of light. This is the exponentially decaying evanescent field. Thus, there are two categories of energy coupling from the prism, one due to the intimate contact of the toner particles with the prism surface and another due to the toner particles located near the prism surface mediated by the evanescent field. In the first case, the internal reflectivity of the prism surface is reduced by transmission into the toner particles, characterized by an index of refraction and an absorption coefficient. The second operates by evanescent field coupling of energy from the prism surface to the toner particles rather than relying on intimate contact between the surface and the toner particles. It appears that the evanescent field effect dominates to produce the large signal sensitivity that has been found in this sensing apparatus.

Figure 11:
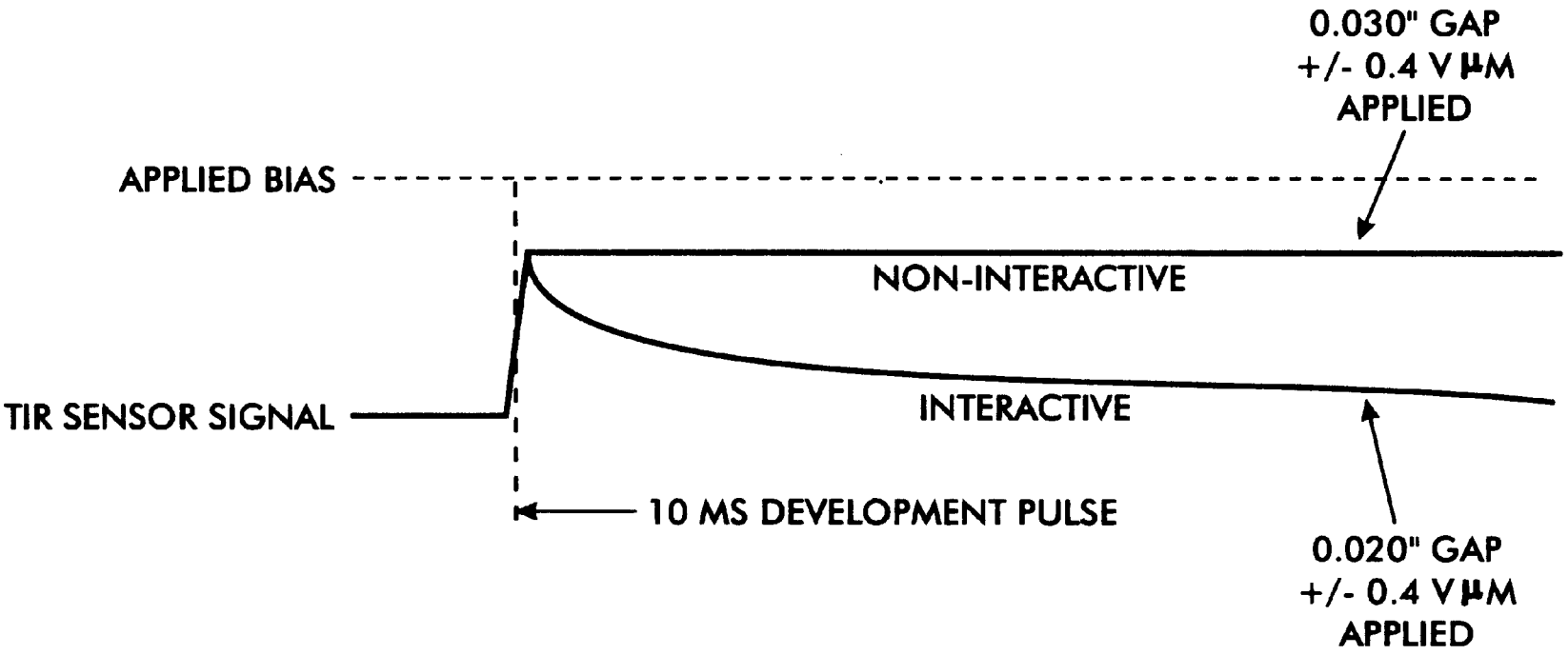
FIG. 11 is a graph showing TIR sensor signal indicating interaction.

Applicants have found that with the TIR sensor 160 applied as a surrogate receptor surface spaced appropriately from a development roll (as shown in FIG. 8). The TIR sensor may be used to monitor scavenging which can occur when carrier beads are allowed to touch the biased surface of the sensor 160. Scavenging or interactivity may also occur when toner from the donor roll is allowed to aggressively interact, due to, for example, excessively high AC bias components, with the previously deposited toner layer in the presence of the applied cleaning bias. By applying a development potential pulse to the conductive sensor 160 face by voltage supply 196 one can sense the developability of the system, as described supra. For the detection of scavenging controller 161 sends a signal to voltage supply 196 to apply a pulse development bias with a zero bias, or a cleaning bias, one can detect scavenging of the toner deposited during the development pulse application. Scavenging of toner from the prism surface causes a decrease in the sensor signal as shown in FIG. 11. Under typical applied field conditions toner to receptor adhesive forces are great enough such that toner can not be stripped from the surface without the mechanical interaction of carrier beads to promote toner release.

By reducing the sensor to developer roll sleeve gap from 0.030" to 0.020" in the arrangement shown in FIG. 11 development behavior went from a noninteractive to an interactive, or scavenging mode detectable with the TIR sensor.

For the 0.030" gap it is apparent from the TIR signal that no toner scavenging is occurring upon application of the 0.4 V/$\mu$m cleaning field after the deposition resulting from the applied development pulse. Removal (i.e. scavenging) of toner, is indicated by the decrease in TIR sensor signal during this phase with the 0.020" gap implying interaction of carriers with the deposited toner layer is occurring.

Implementation of the TIR sensor in a machine configuration depends upon the NID system architecture. It is necessary to apply the sensing technique in either the actual development zone 112 at a distance equal to the development gap (as shown in FIG. 8), or in a region which closely simulates the behavior in the development zone. Numerous internal reflection elements may be applied to accommodate various implementation modes including fiber, rod, or conical shapes. Design of the developer housing can also account for the required sensor apparatus. For example, the active NID components such as donor roll and electrodes may be extended out beyond the necessary photoreceptor development width.

Application of the TIR sensor for NID evaluation requires the ability to clean the sensor face for subsequent monitor cycles. This can be achieved by a number of techniques. A wiping mechanism is the most straightforward approach.

Camming the sensor away from the development zone could serve to accommodate this approach. Conical reflection elements could be applied to enable rotation of the sensing surface to enable wiping with a fixed blade. The sensor face to developer roll gap could be momentarily reduced to create interaction/scavenging. With the cleaning field applied at the reduced gap the sensor face is cleaned. An approach not involving movement of the sensor apparatus would be to apply a more aggressive bias cycle consisting of both DC and/or AC voltages applied to the prism surface to again invoke interactivity.

If desired, the sensing technique could distinguish effects due to line and solid areas by using various electrode patterns on the sensor face. The effects of recharge processes could be included by adjusting biases accordingly or even incorporating a recharge step into the sensing process.

While the invention has been described with reference to the structure disclosed, it is not confined to the specific details set forth, but is intended to cover such modifications or changes as may come within the scope of the following claims.

We claim:

1. An apparatus for developing a latent image recorded on a surface, comprising:

a housing defining a chamber storing a supply of developer material comprising toner;

a donor member, spaced from the surface, for transporting toner to a region opposed from the surface, said donor member having means for detaching toner from said donor member as to form a toner cloud for developing the latent image;

a sensor, in contact with said toner cloud, for detecting interactivity of said toner cloud.

2. The apparatus of claim 1, wherein said sensor includes a transparent member positioned closely adjacent to said donor member wherein toner is attracted from donor member to transparent member;

a light source for generating a beam to be transmitted through the transparent member;

a light detector for sensing an intensity of an internally reflected beam, said light detector generating a signal indicative of a quantity of toner adhering to the transparent member; and means for generating a cleaning field bias on said transparent member having toner adhering thereon, said light detector generates a signal indicative of the toner being removed (interactivity) from the transparent member.

3. The apparatus of claim 1, further comprising a controller responsive to said sensor, for individually adjusting electrical parameters of said developer apparatus to prevent scavenging.

* * * * *